United States Patent [19]

Witte

[11] 3,999,270

[45] Dec. 28, 1976

[54] WIRE INSERTION APPARATUS

[75] Inventor: Roy Witte, Rolling Meadows, Ill.

[73] Assignee: TRW Inc., Elk Grove Village, Ill.

[22] Filed: Feb. 13, 1975

[21] Appl. No.: 549,715

[52] U.S. Cl. ..... 29/203 MW; 29/203 P; 29/203 J

[51] Int. Cl.[2] ..... H01R 43/04

[58] Field of Search ... 29/203 MW, 203 D, 203 DT, 29/203 H, 203 HT, 203 P, 203 J, 628

[56] References Cited

UNITED STATES PATENTS

| | | | |
|---|---|---|---|
| 3,800,390 | 4/1974 | Johnston | 29/203 MW |
| 3,803,695 | 4/1974 | Tucci | 29/203 H |
| 3,845,535 | 11/1974 | Over | 29/203 MW |
| 3,872,567 | 3/1975 | Cea et al. | 29/203 MW |
| 3,886,641 | 6/1975 | Davis | 29/203 MW |

*Primary Examiner*—Carl E. Hall
*Attorney, Agent, or Firm*—Neuman, Williams, Anderson & Olson

[57] ABSTRACT

A termination tool is disclosed of the type for simultaneously forcing a plurality of wires laterally into terminals on opposite sides of a connector. Wire locating combs are provided at each side of a connector holder and include a plurality of ribs extending to progressively varying heights above a connector mounted in the holder, to facilitate selective placement of the wires by the operator.

17 Claims, 12 Drawing Figures

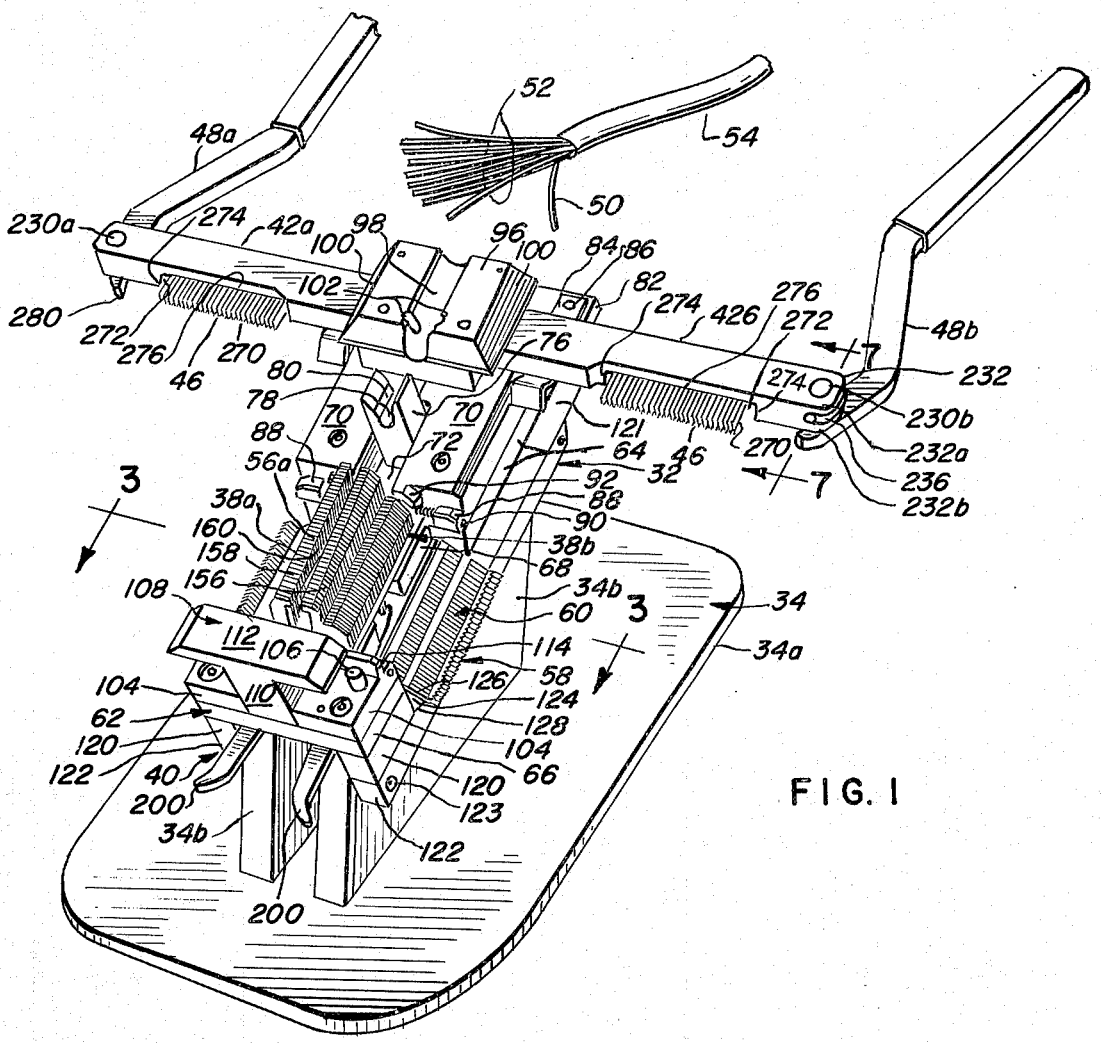
FIG. 1
FIG. 2
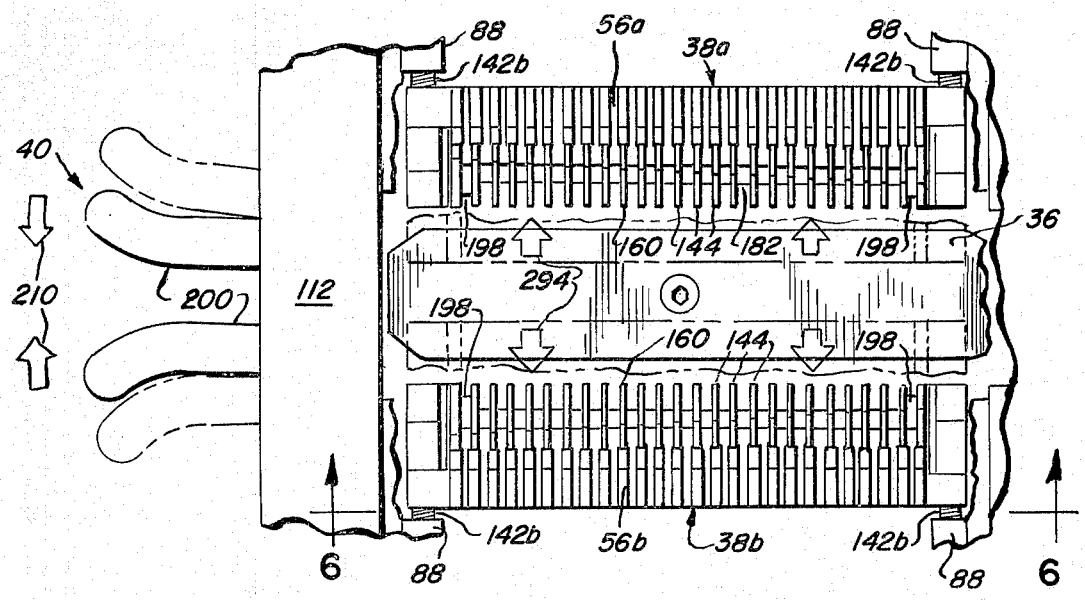

FIG. 2a
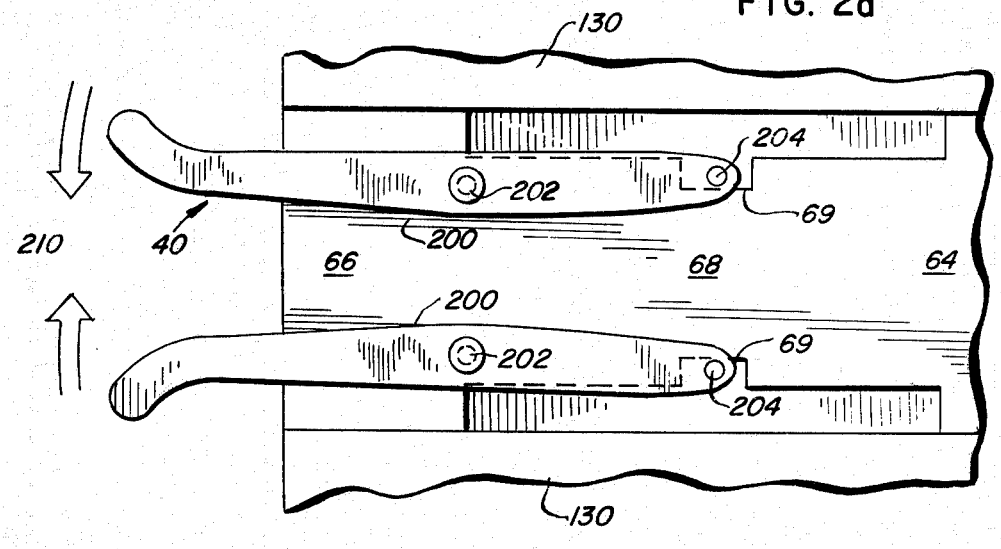
FIG. 7
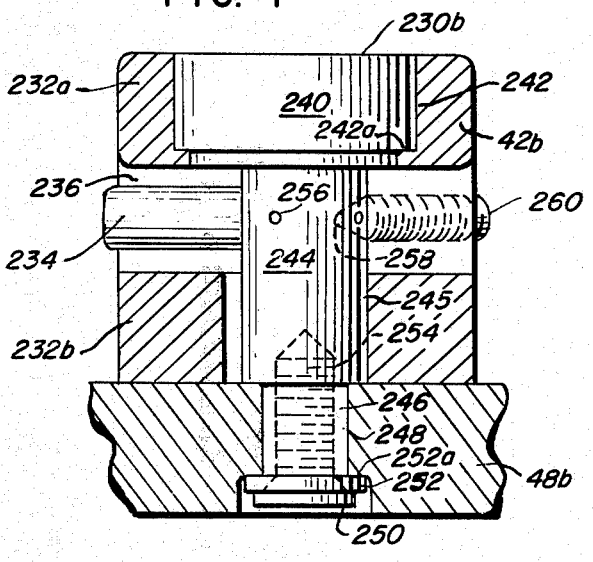
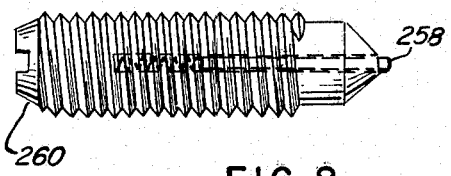
FIG. 8
FIG. 9
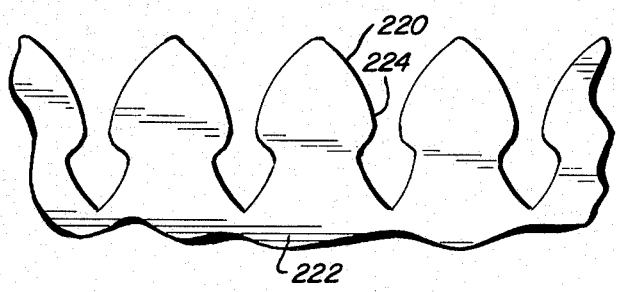

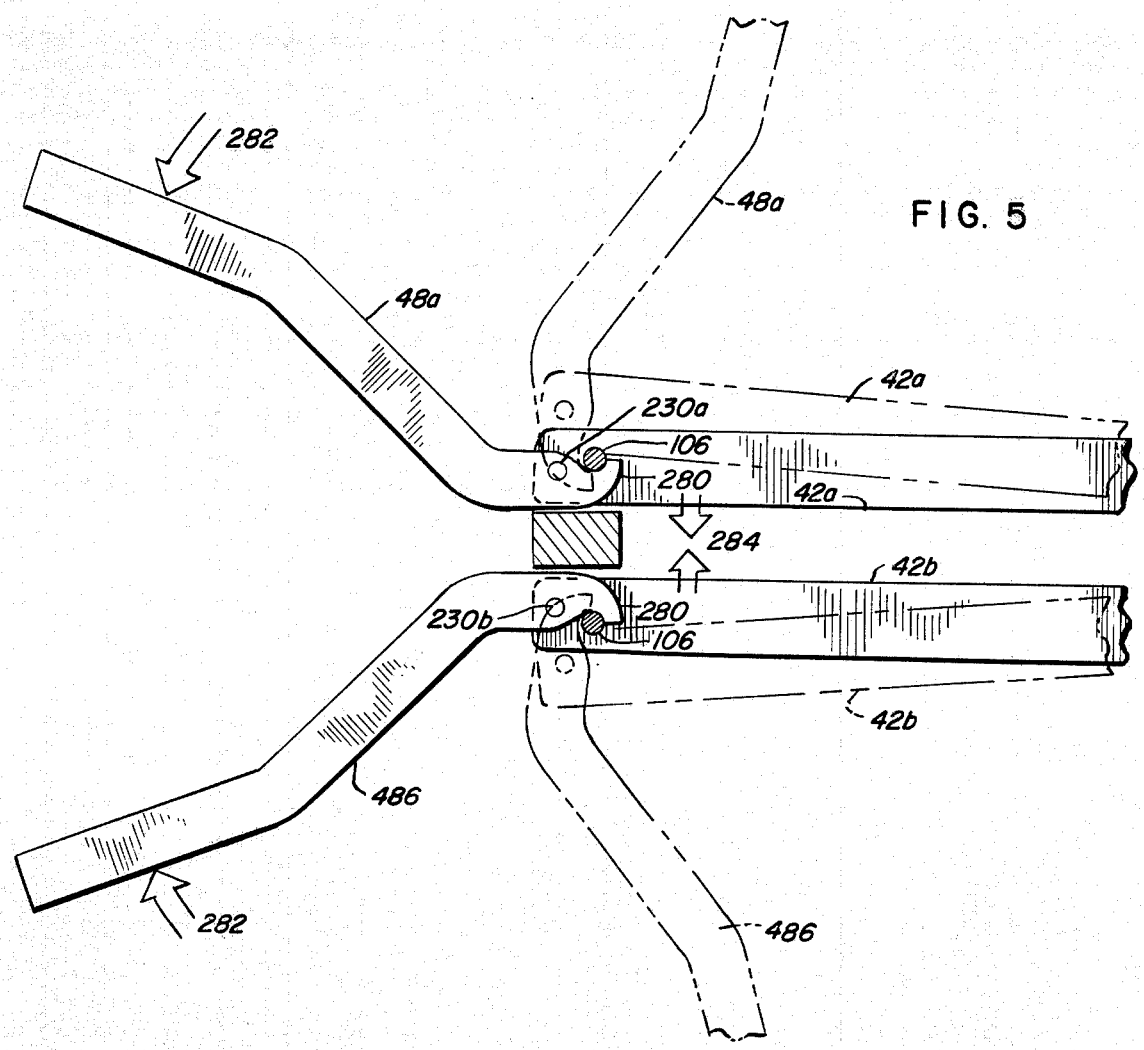
FIG. 5
FIG. 6
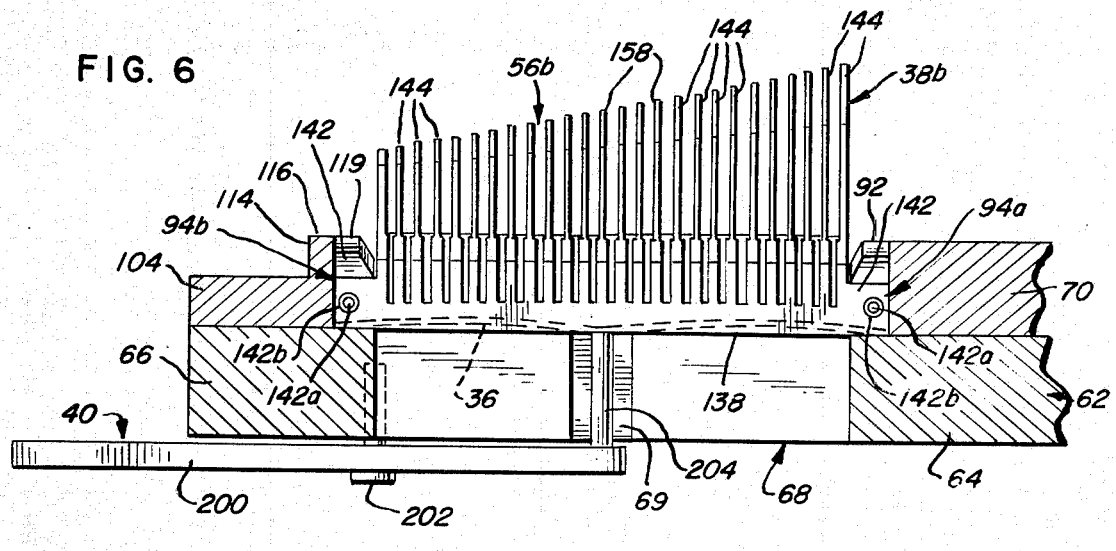

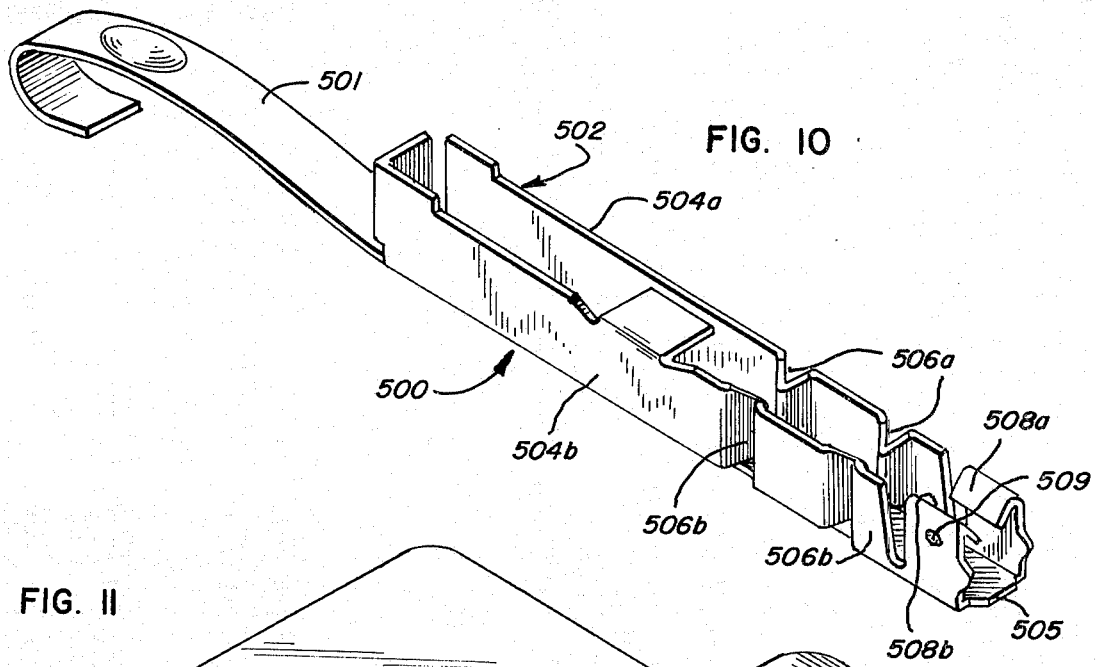
FIG. 10
FIG. 11
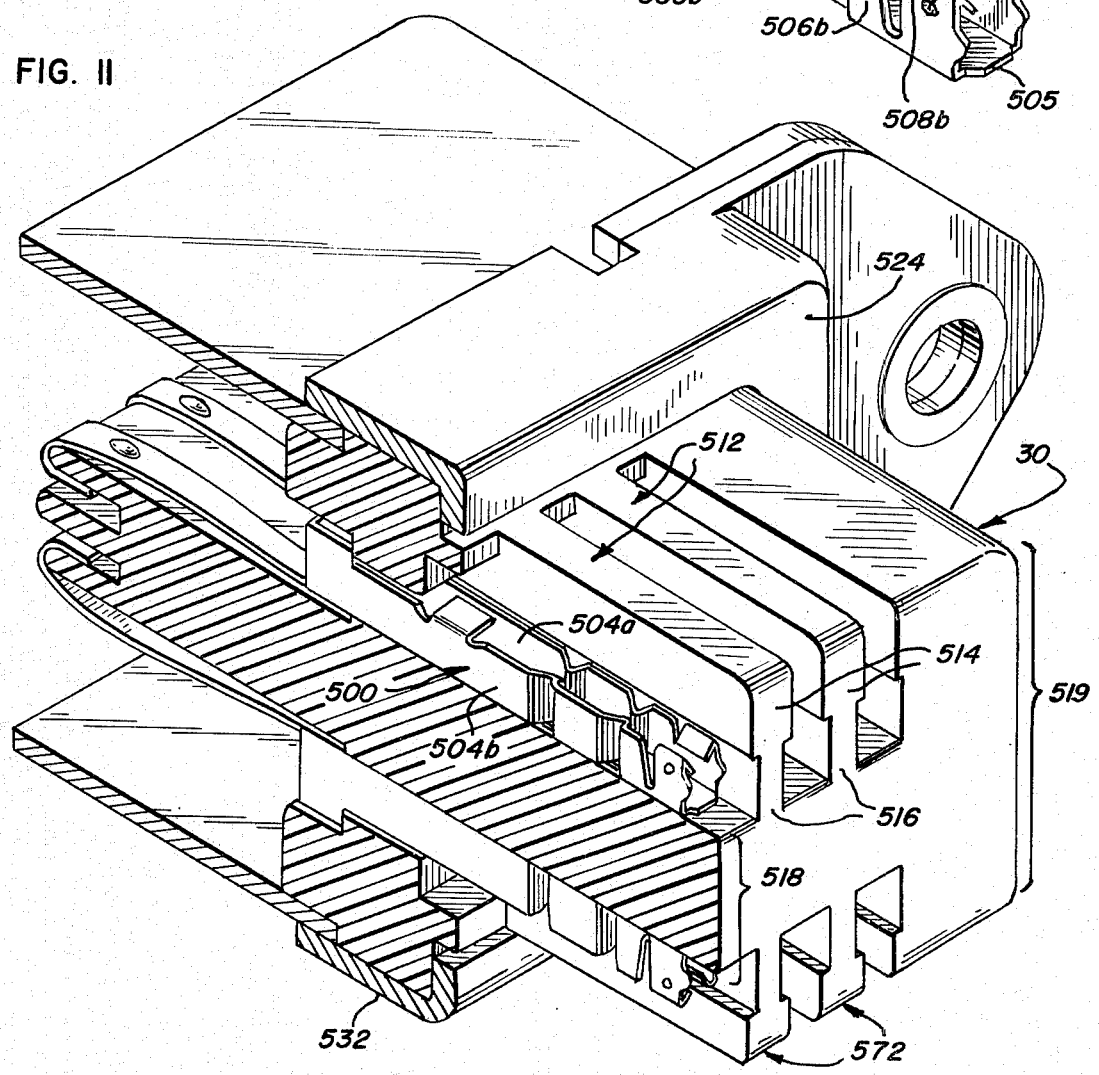

WIRE INSERTION APPARATUS

This invention relates to apparatus for terminating wires in connectors and, specifically, to apparatus for terminating wires in solderless connectors.

In recent years, numerous forms of solderless connectors have been developed. These include improved connectors employing an improved terminal such as illustrated in FIGS. 10 and 11 of the drawings herein and disclosed more fully in two copending applications, namely, McKee application Ser. No. 443,730, filed Feb. 19, 1974 and McKee and Witte application Ser. No. 443,678, filed Feb. 19, 1974. In conjunction with the development of various connectors, a variety of devices for inserting wires in such connectors have been produced. By way of example, various tools and devices for effecting terminations in solderless connectors are disclosed in three copending applications, namely, McKee application Ser. No. 502,085, filed Aug. 30, 1974, McKee application Ser. No. 502,086, filed Aug. 30, 1974, and Haller application Ser. No. 549,714 filed Feb. 13, 1975.

It is an object of this invention to provide improvements in wire insertion apparatus and, more specifically, to provide improvements which assist an operator in positioning multiple wires for subsequent insertion into connectors of the general type disclosed in the aforementioned applications. While the apparatus disclosed herein is adapted to connectors employing solderless terminals, the invention is by no means limited to that particular use. Many applications of the invention disclosed herein, all equally within its spirit and scope, will become obvious to those skilled in the art. Similarly, further and additional objects and advantages will appear from the description, accompanying drawings and appended claims.

In an illustrative embodiment of this invention, a termination tool is employed of the type for simultaneously inserting a plurality of wires into a row of closely spaced parallel terminals of a connector wherein each of those terminals is open through one side and one end of the connector. The tool includes means for supporting such a connector in a predetermined position and a plurality of rams for forcing wires laterally into the terminals of the connector. Guide combs are provided adjacent the connector holding position. Each of the combs includes wire spacing dividers which are aligned with the terminal divisions of the connector and which extend beyond the outward end of a connector mounted in the tool. The extension of such dividers varies progressively from one end of the connector position to the other end, in a stepped configuration, to assist an operator in selectively positioning wires between the dividers. Secondary combs are provided to retain the ends of wires which have been positioned by means of the guides.

For a more complete understanding of this invention, reference should now be had to the embodiments illustrated in greater detail in the accompanying drawings and described below by way of examples of the invention.

In the drawings:

FIG. 1 is a perspective view of a termination tool employing teachings of the invention;

FIG. 2 is a partial plan view of the connector holder and comb assembly of the tool shown in FIG. 1, with the holder control shown in two positions of operation;

Figure 3:
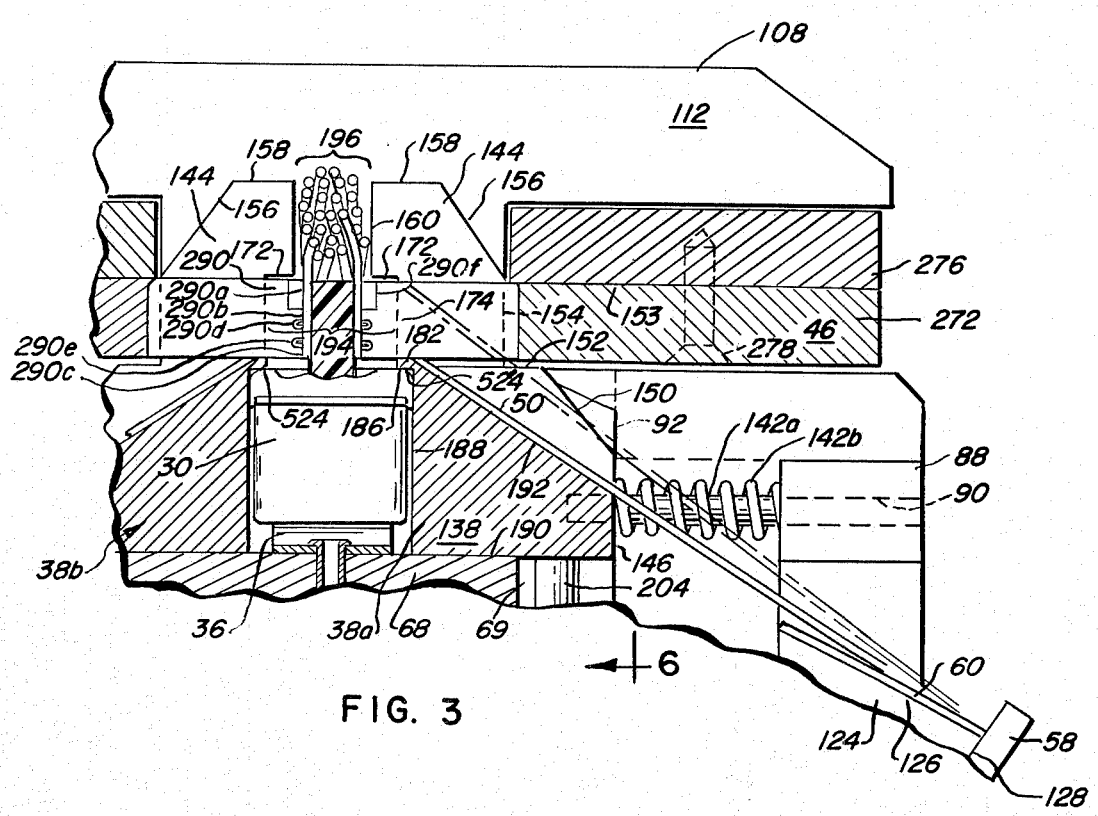
Figure 4:
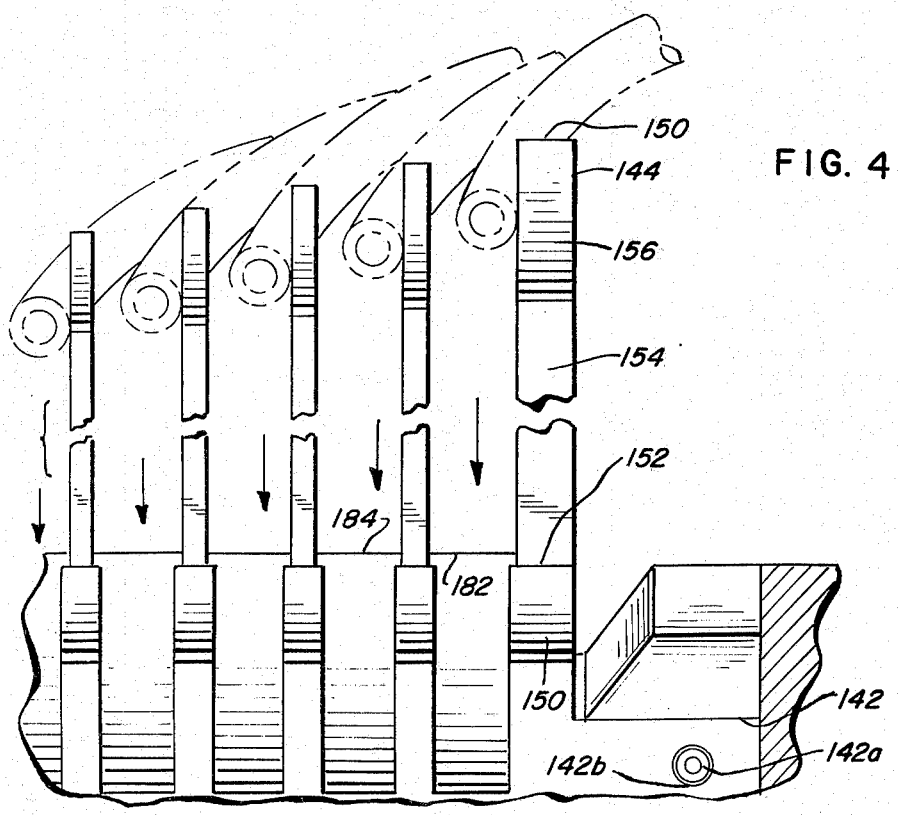

FIG. 2*a* is a partial bottom view of the connector holder assembly and the control therefor of the tool shown in FIG. 1;

FIG. 3 is a partial sectional view of the tool shown in FIG. 1 with a connector mounted thereon and with the ram arms closed after having forced wires into the connector, as taken generally along the line 3—3 shown in FIG. 1 and looking in the direction of the arrows;

FIG. 4 is an enlarged side view of a portion of the guide comb of FIG. 1, and schematically representing insertion of wires into the comb;

FIG. 5 is a schematic view of the ram arms and related mechanism shown in FIG. 1 in two positions of operation;

FIG. 6 is a partial sectional view of the tool of FIG. 1, taken generally along the line 6—6 shown in FIG. 2 and looking in the direction of the arrows;

FIG. 7 is a sectional view of a ram arm, taken along the line 7—7 shown in FIG. 1 and looking in the direction of the arrows;

FIG. 8 is a side view of a pin shown in FIG. 7;

FIG. 9 is a partial side view of the secondary comb shown in FIG. 1;

FIG. 10 is an enlarged oblique view of an individual terminal of the type included in a connector shown in FIGS. 3 and 11; and FIG. 11 is an enlarged partial view of a multiterminal connector, including a plurality of terminals shown in FIG. 10.

Referring now to the drawings, FIG. 1 shows an illustrative tool employing guide combs in accordance with the invention. The tool is designed for holding a connector 30 (FIGS. 3 and 11) and terminating a plurality of wires therein. The tool includes a frame assembly 32 mounted on a support 34. The support comprises a base plate 34*a* and pedestal members 34*b*, which are configured such that the frame assembly 32 and the manipulative components of the tool are maintained at an inclined attitude facing an operator. Referring also to FIGS. 2, 2*a* and 3, those manipulative components include generally a connector holder assembly comprising a flat double bow support spring member 36, a pair of laterally slidable side members 38*a* and 38*b* and a holder control assembly shown generally at 40, together with a pair of ram arms 42*a* and 42*b* which carry ram blocks 46 and a pair of force amplification arms 48*a* and 48*b*. The spring member 36 and side members 38*a* and 38*b* form a carriage or nest in which a connector is held while terminating wires 50–52 of a cable 54 in the connector.

The side members 38*a* and 38*b* include guide combs 56*a* and 56*b*, each consisting of a plurality of ribs 144. The spaces between these ribs are registered with the terminals of a connector such that the ribs of the combs serve to align wires 50 and 52 therebetween with the terminals of the connector 30 as the wires are prepositioned and subsequently are terminated in the connector by the rams of ram blocks 46, upon appropriate manipulation of the arms 42*a* and 42*b* and the arms 48*a* and 48*b*. As will be pointed out further below, the guide combs are of advantageous configuration to facilitate placement of the wires therein by an operator.

A secondary comb 58 and a color code plate 60 are provided on each side of the frame, beneath the side members.

Referring now particularly to FIGS. 1, 2, 2*a*, 3, 4 and 6, the frame assembly 32 includes a frame support plate 62 having a forward portion 64 and a rearward portion 66, connected by a central portion 68. The central portion 68 is of reduced width relative to the end portions 64 and 66, and includes a notch 69 extending laterally inward approximately midway between these end portions. A pair of arm support plates 70 are mounted on the forward portion 64 of the plate 62. The arm support plates define a central recess 72. A cable clamp 76, having a cable receving depression 78 and opposed jaws 80, is mounted centrally of the tool within the recess 72 in the plates 70. The arm support plates 70 include at their forward ends lateral flanges 82 to which are mounted detent spring members 84, by screws 86, for retaining arms 42*a*–42*b* in the open position of FIG. 1. In addition, arm support plates 70 include, at their rearward lower outer corners, extensions or bosses 88 having pin receiving holes 90 extending laterally of the tool. At their upper inner corners the plates 70 also include rearward extending flanges 92 which, together with a corresponding underlying portion of the plate portion 64, form lateral slideways or channels 94*a* (FIG. 6) for the side members.

As an arm mounting member 96 is mounted at the forward end of the plates 70 and centrally of the tool. The arm mounting member 96 includes a centrally located longitudinal depression 98, suitable for receiving the body of the cable 54. The member 96 also includes laterally extending flanges 100 which receive pivot pins 102 for mounting the arms 42*a* and 42*b*.

A pair of fulcrum support plates 104 bearing fulcrum posts 106 are mounted on the rear portion 66 of the frame plate. A T-shaped guide member 108, having a vertical portion 110 and a horizontal portion 112, is mounted centrally between the support plates 104. Each fulcrum support plate also includes a laterally extending rib 114 with a top surface 116 a predetermined distance above the plate portion 66. In addition, the fulcrum support plates include forwardly extending bosses 118 at their lower outer corners and fowardly extending flanges 119 (FIG. 6) at their upper inner corners, corresponding to the bosses 88 and flanges 92 extending rearwardly from the plates 70. The flanges 119 form lateral slideways 94*b* with corresponding portions of plate portion 66.

Two rear mounting bars 120 are secured to the underside of the rear frame plate portion 66 adjacent the lateral edges thereof on opposite sides of the tool, and two forward mounting bars 121 are secured to the underside of the frame plate portion 64 adjacent the lateral edges thereof on opposite sides of the tool. Pedestal mounting rails 122 are secured to the under surfaces of the mounting bars 120 and 121. These rails are employed to mount the tool on the pedestal members 34*a* and 34*b* using bolts 123.

Two support blocks 124 are mounted on opposite sides of the tool in the vicinity of plate portion 68, between corresponding mounting bars 120 and 121. The support blocks 124 are mounted with adjoining surfaces 126 and 128 extending generally diagonally of the tool. The upper surfaces 126 extend generally inward and upward of the tool and have the color code plates 60 mounted thereon. The lower surfaces 128 extend generally inward and downward of the tool and have the secondary combs 58 attached thereto.

The side members 38*a* and 38*b* are in virtually all respects mirror images of each other and will be discussed accordingly. Each of these members is an integral element, typically being machined from a block of metal. Each side member includes a base portion 138. Rails 142 extend from each end of the side members and are of appropriate dimensions to engage the slideways 94*a* and 94*b* formed by the flanges 92 and 119 and corresponding portions of the plate portions 64 and 66. Each carries a laterally extending guide pin 142*a* which is slidably received in the hole 90 in the respective adjacent boss 88. Each pin 142*a* is surrounded by a compression spring 142*b* confined between the side member and the inward surface 143 of the corresponding boss 88. As a result, the springs 142*b* urge the side members inwardly of the tool. Consequently, when the side members are forced laterally outward of the tool, the pins slide into the hole 90 and the compression springs 142*b* are further compressed.

Guide combs 56*a* and 56*b* which are parts of the side members 38*a* and 38*b*, respectively, include a plurality of ribs which extend vertically of the tool from the base portion 138 of each side member to levels above a connector 30 gripped in the holder assembly. More specifically, each comb includes plurality of ribs 144, each of generally similar shape, but varying in some respects one with another, particularly in height. An outer edge surface 146 of each rib extends vertically from the outer surface of the respective portion 138 and adjoins a surface 150 which extends upwardly and inwardly of the tool. The surface 150 is terminated at a horizontal surface 152 which extends inwardly of the tool. The surface 152 adjoins a vertical surface 154 which on all of the ribs, extends to a level approximately that of the upper surfaces 153 of the ram blocks 46. A surface 156 extends upwardly and inwardly of the tool from each surface 154 to a horizontal top edge surface 158. As a result of the milling technique used, the lengths of the surfaces 156 vary with each of the respective ribs from one end of the combs to the other, as can be seen in FIGS. 1, 2 and 4.

Each surface 158 adjoins a vertical inner surface 160 which varies in height with each of the respective ribs, as can be seen in FIG. 1. This is due to the fact that the ribs 144 vary in height in stepped sequence from the tallest ribs at the forward ends of the combs to the shortest ribs at the rearward ends of the combs. This stepped variation assists an operator in differentiating one rib from another, or more specifically in differentiating and selecting individual wire spaces for selectively locating wires in the proper spaces between the respective ribs for later insertion of those wires into the proper terminals of the connector. As best seen in FIG. 4, each individual surface 158 is normal to the plane of the respective rib 144, e.g., is a horizontal surface in two axes, being parallel to plate portion 68. This normal characteristic accentuates the beneficial stepped height characteristic of the combs.

Each surface 160 adjoins a horizontal surface 172 which, in turn, adjoins a vertical surface 174. The surface 174 extends downward of the tool a distance approximating the length of the surface 154 and merges with coplanar inner surfaces of bridging segments 182 which form, with the ribs, continuous longitudinal bar portions 184 of the respective side members 38*a* or 38*b*. The horizontal undersurfaces 186 of the bar portions 184 adjoin surfaces 188 extending vertically to the bottom surfaces of the base portions 138. Surfaces 192 form the bottom walls of the channel spaces between adjoining ribs and slope diagonally outward and downward across the combs from the bridging segments 182. The side members 38*a* and 38*b* and particularly certain of the noted surfaces, are dimensional for fitting engagement with the connector 30.

A connector inserted between the side members rests upon spring member 36. When the side members are forced into close engagement with corresponding surfaces of a connector by the spring 142*b*, the spring 36 becomes slightly compressed. More specifically, as illustrated in FIG. 3, when the surfaces 186 engage lateral shoulders 524 (FIG. 11) of a connector, the connector is forced downward and the spring 36 becomes slightly compressed. Also, the surfaces 174 are positioned such that the distance 194 between opposing surfaces 174 when the side members are closed on the connector approximates the distance 519 between the outer surfaces of corresponding ribs on opposite sides of the connector 30; see again FIG. 11. This dimension and the other dimensions related to the connector into which wires are being terminated may vary, of course, with different types of connectors and between male and female connectors of the same general type. Further, the surfaces 160 are positioned sufficiently inward of the tool that the distance 196 between the surfaces 160 of the opposing ribs 144 approximates, but is slightly greater than, the distance 518 between the bottoms of corresponding terminal channels on opposite sides of a connector 30 as shown in FIG. 11.

At each end of each row of bridges segments 182, the respective bridging segment includes an integral nub 198 (FIG. 2) extending inwardly of the tool. The nubs 198 serve to extend into the terminal at each end of a row of terminals of a connector 30 and insure registry of the connector terminals with the channel spaces of the combs.

Referring specifically to FIGS. 2, 2*a* and 6, the control assembly 40 includes a pair of lever arms 200 pivotally mounted by pins 202 to the plate 62. The rearward ends of the arms 200 are arcuate to assist an operator in gripping such ends between his thumb and fingers. Pins 204 are mounted in the forward ends of the lever arms and extend upward through slots 69. These pins engage in the faces 138 of the respective side members 38*a* and 38*b* for lateral sliding movement of the side members against the force of springs 142*b* by manipulation of the levers 200. When the lever arms 200 are moved in the direction of the arrows 210 (FIG. 2), the side members 38*a* and 38*b* are moved outwardly of the tool as illustrated in FIG. 2 and the distance between their innermost surfaces 160 becomes sufficient to permit a connector 30 to be inserted therebetween or removed therefrom. Such movement further compresses springs 142*b* which then act to restore the side members to their respective rest positions in gripping engagement with a connector 30 as seen in FIG. 3.

As indicated above, the color code plates 60 and the secondary combs 58 are mounted to the surfaces 126 and 128, respectively, of the blocks 124. Each color code plate 60 includes a chart to assist an operator in selecting and properly locating appropriately color-coded wires.

Each secondary comb 58 includes a plurality of flexible ribs 220 (FIG. 9) extending in a linear array from a base member 222. The ribs include enlarged end portions 224 of sufficient dimensions to prevent a wire, such as wire 50, from being placed between ribs or from being removed without adequate force to flex the ribs. Below the enlarged portion 224 the ribs are V-shaped and of dimensions such that a wire placed therebetween is not subject to any substantial compressive force.

Referring to FIGS. 1, 5 and 7, the ram arms 42*a* and 42*b* are pivotally mounted to the arm mounting member 96 by pins 102. The force amplification arms 48*a* and 48*b* are pivotally mounted to the arms 42*a* and 42*b* by means of the pins 230*a* and 230*b*, respectively. The pin 230*b* is mounted in a clevis 232 in the arm 42*b* and is itself an eccentric pin with an adjustment pin 234 attached thereto and extending in a space 236 (FIG. 7) between clevis elements 232*a* and 232*b*.

Referring to FIG. 7, the pin 230*b* includes an upper cylindrical section 240 fitting within a vertical bore 242 in arm 42*b* and resting on an annular shoulder 242*a* of the arm. Extending from the upper section 240 is a central cylindrical section 244 of a lesser diameter than the bore 246 in arm 42*b* through which it extends. The adjustment pin 234 is connected to this section 244. Extending from the section 244 is a further cylindrical section 246 of lesser diameter than the section 244. The vertical axes of sections 244 and 246 are mutually aligned and are offset or eccentric with respect to the vertical center axis of the section 240. The section 246 extends through and fits a bore 248 in the arm 48*b* and is secured thereto by a screw 250 which passes through a counter-sunk washer 254 into a tapped hole 252 in the pin 230*b*. The washer 252 engages shoulders 252*a* of the arm 48*b*. The eccentric character of the pin 230*a* permits the pivot axis of the arm 48*b* to be moved laterally of the arm 42*b*. More specifically, when the pin 230*a* is rotated by means of adjustment pin 234, the cylindrical section 240 rotates within the bore 242. The section 246 forming the pivot pin for the arm 48*b* is thus moved laterally of the arm 42*b*.

The section 244 also includes a plurality of dimples 256 disposed at 90° angles about its circumference and positioned to mate with a spring loaded detent plunger 258 extending from the inner end of a set-screw 260 mounted in the arm 42*b*. The spring is effective to urge the plunger 258 into an aligned dimple 256 to maintain the rotational position of the pin 230*a* after it has been manually positioned.

The pivot pin 102 for arm 42*b* is similar in form and function to that of the pin 230*b*. Thus, the pin 102 for the arm 42*b* may be rotated to adjust the pivot axis of arm 42*b* laterally of the tool, by employing a screwdriver or similar device to engage a groove (not shown) in the upper end of that pin.

Referring particularly to FIGS. 1 and 3, each of the ram blocks 46 includes a plurality of rams 270, all protruding in mutually parallel relationship to one another from a base section 272. Each of the base sections 272 is laterally confined by ends 274 of a slot 276 in the underside of the respective ram. The ends align the blocks, longitudinally of the arms 42*a* and 42*b*, such that the individual rams 270 pass in the interstices between ribs 144 when the arms 42*a* and 42*b* are rotated toward the closed position of FIG. 3. Each of the ram blocks is secured to the respective arm by screws 278 (FIG. 3) extending into the arm from the underside of the block.

Each of the arms 48*a* and 48*b* includes a jaw 280 (FIGS. 1 and 5) of an appropriate configuration for engaging the respective fulcrum post 106 very near the respective pin 48*a* or 48*b*. The arms 48*a* and 48*b* thus function as second class levers to apply a large closing force to the respective arms 42*a* and 42*b* through the pins 230 as a result of operator force applied at 282.

The closing is shown schematically in FIG. 5 where both sets of arms are shown in two positions of operation. First, the phantom lines show the two sets of arms after preliminary closing and positioning of the arms, just prior to application of force for final termination of wires in an insertion operation. Thereafter, as the rams 46 are moved toward one another by application of manual effort to arms 48*a* and 48*b* in the direction of the arrows 282, the jaws 280 bear against fulcrum posts 106 and a closing force of large magnitude is applied through the pins 230*a* and 230*b* to the arms 42*a* and 42*b*, respectively, in the direction of the arrows 284. Such closure, of course, is effected after wires have been duly positioned in the combs 56*a* and 56*b*, and forces the wires into the terminals of the conductor.

The provisions above described for varying the pivot points for the arm 42*b* and its connected arm 48*b* accommodate variations in the lateral dimensions of connectors mounted on the tool. By translating the pivot point of the arm 48*b* outwardly and also translating the pivot point of the arm 42*b* outwardly an equal amount, a commensurately thicker connector may be accommodated by the tool, i.e., the dimensions of the tool are compensated for the variations between male and female connectors and the like. By employing such adjustment, the direction of travel of the ram blocks 46 at the point of insertion of wires into terminals of the connector 30 mounted on the tool is maintained substantially parallel to the lateral axis of the tool even though a connector mounted on the tool is of a greater (or lesser) width than previously employed.

In preparation for a discussion of the previously mentioned insertion end portions of the rams 270 and a discussion of the actual insertion of wires into a connector 30 by means of the illustrated tool, reference is first made to FIGS. 10 and 11 wherein the connector 30 and the terminals used in the connector are illustrated.

As was mentioned, the terminal shown in FIG. 10 is fully described in the noted copending applications. However, a brief description of the terminal and the connector shown in part in FIG. 11 is included here for convenience. Specifically, a terminal 500 includes a contact finger 501 and a trough or channel-like body section 502 defined by parallel sides 504*a* and 504*b* and a bottom or rear wall 505. Along the length of the trough 502 jaws 506*a* extend from the side 504*a* into the trough, and opposing jaws 506*b* extend from the side 504*b* into the trough. The opposing pairs of jaws thus form narrowed areas in the trough. Opposing strain-relief tabs 508*a* and 508*b* extend from the upper edges of the respective sides angularly downward into the trough, over support dimples 509. Consequently, the cross-section of the trough 504 varies along its length. This configuration of the trough 504 is useful with respect to the solderless connection of wires therein. More specifically, the insulation of a wire forced laterally into the trough between the jaws 506, in a direction of movement transverse to the longitudinal axis of the wire, is torn or ruptured by the jaws, the electrical contact is established between the jaws 506 and the conductor core of the wire. In addition, the insulation of a wire forced between the tabs 508 is gripped by these tabs which then serve the function of a strain-relief mechanism.

Referring to FIG. 11, several terminals 500 are assembled in a connector 30, e.g., 50 terminals in two opposed row for terminating 25 pairs of telephone wires. The connector 30 includes parallel-spaced rib 512, some of which have been cut away in FIG. 11 for clarity of presentation. The ribs 512 include outer guide portions 514 and inner support portions 516 which abut the sides 504*a* and 504*b*. The abutment support portions 516 serve to support the sides of the terminals 500 to prevent spreading of the opposed sides and expansion of the trough therebetween when a wire is forcibly inserted therein.

In the above discussion, reference was made to the distances between the bottoms of corresponding terminal channels and between the outer surfaces of corresponding ribs on opposite sides of the connector. Those distances are indicated in FIG. 11 at 518 and 519, respectively, and vary in different makes and models of connectors.

A detailed discussion of the characteristics of the insertion end portion of the individual rams 270 is included in a copending application of W. H. McKee, Ser. No. 502,086, filed Aug. 30, 1974. However, referring briefly to FIG. 3, the insertion end portion or blade 290 of each ram 270 includes an insertion surface consisting of co-planar surfaces 290*a*, 290*b* and 290*c*. These surfaces are separated by depressions 290*d* and 290*e*. In addition, each surface segment 290*a* includes a portion 290*f* of diminished thickness. As will be seen subsequently, these characteristics of the blades 290 permit them to be used successfully with the aforementioned solderless terminals.

Referring to FIGS. 1, 2*a*, 3 and 6, a connector 30 is placed within the above described connector holder by manipulating the control 40 assembly, specifically the levers 200, to translate the side members 38*a* and 38*b* in the direction of arrows 294 in FIG. 2*a*. Thereafter, the connector is placed on the spring 36 (as shown in FIG. 3) and the levers 200 are released. This results in the translation of the side members leased. This results in the translation of the side members 38*a* and 38*b* opposite the direction of the arrows 294. If the terminal channels at each end of the connector are properly aligned with the previously described nubs 198, the side members 38*a* and 38*b* engage the sides of the connector and the nubs 198 restrain the connector in proper alignment with the ribs 144 and rams 270 longitudinally of the tool. As described above and shown in FIG. 3, the connector 30 is maintained in firm contact with the resilient support member 36 by engagement of the surfaces 196 upon the shoulders 524 of the connector to effect vertical alignment of the connector with the rams 270.

After the connector is placed in the connector holder, the wires such as wire 50 are individually placed in the interstices between the ribs 144. This placement is illustrated generally in FIG. 4, where it can be seen that the wires 50 and 52 are individually placed between the respective ribs 144 and moved downward. The combs 56a and 56*b* assist the operator in so placing the wires. More specifically, in the illustrated type of tool, the operator typically first bends or "fans" all of the wires 50 – 52 of a cable 54 forwardly and upwardly from the clamp 76. Normally the wires then are positioned in the combs two-at-a-time, progressively from the rear of the connector forward (toward the operator), for alignment with the appropriate opposed terminals. Thus, a pair of the wires extending forwardly and up from the clamp 76 is grasped by the operator, then moved forwardly and downward over the connector in the area between the combs and over previously located wires (see FIG. 3). Each wire of the pair then is bent outward generally over the appropriate space between the ribs 144 of the respective comb and is moved downward into that space, and subsequently is moved fully downward and drawn taut for proper dressing or positioning by pulling on the outer tail end. Each rib 144 extends substantially and over the top of the connector to assist in this location and insertion manipulation of the wires by the operator, e.g., the top surface 158 of the forward shortest rib extending above the connector a distance greater than the diameter of a wire 54. The stepped height arrangement of the ribs further facilitates the operators' space selection and wire locating operations. In the illustrative tool the total difference in height between the tallest and shortest ribs 144 is approximately 0.20 inch, and this height difference is distributed in twenty five uniform steps (about 0.008 inch each) between successive ribs. Moreover, the inner edge surfaces 160 of the ribs 144 insure compact center placement of the wires over the connector, as seen in FIG. 3. After havng placed a wire such as wire 50 between ribs 144, its distal end is placed between corresponding ribs 220 of the secondary comb 58 which are themselves aligned with the ribs 144, and the end may be bent about the respective rib 220 to provide restraint against axial movement of the wire.

After all of the wires 50 and 52 have been placed in appropriate interstices between the ribs 144, the ram arms 42*a* and 42*b* with their rams 270 are pivoted closed to insert the wires into the respective terminals by manipulation of the arms 42*a*, 42*b*, 48*a* and 48*d* as described above. More specifically, as the rams 270 are moved between the ribs 144, the surfaces 290 of the blades engage the wires, for example, the wire 50 in FIG. 3, and force them against the shear edges of the bridging segments 182. As a result, each wire is trimmed. As the rams are further inserted between the ribs 144, the wires are pushed further into the respective connector terminals until all of the wires are seated firmly against the bottom walls 505. The depressions 290*d* and 290*e* and the diminished areas 290*f* in the blades 290 permit the blades to be fully inserted in the terminals without damaging the jaws 506 and the tabs 508 of the terminals. Thereafter, the rams are withdrawn and the insertion operation is complete. At this point, the distal ends of the inserted wires, namely, those ends which have been trimmed from the inserted wires, are removed from the tool by pulling them from between the ribs of the comb 58.

In describing certain components herein, the terms horizontal and vertical have been used for convenience. It will be appreciated that in some instances such terms are relative to the inclined support frame plate 32, and should be construed accordingly.

It will be obvious that other modifications of the specific embodiments shown may be made without departing from the spirit and scope of the invention.

It will be seen that improvements in wire termination apparatus have been provided which meet the objects of the invention.

While a particular embodiment of this invention has been shown, it will be understood, of course, that the invention is not limited thereto since modifications may be made by those skilled in the art, particularly in light of the foregoing teachings. Therefore, it is contemplated by the appended claims to cover any such modifications as incorporate those features which may be said to constitute the essential features of these improvements within the true spirit and scope of the invention.

What is claimed is:

1. Apparatus for inserting wires into a connector having a row of closely spaced parallel terminals each open through one side and one end of such connector comprising:

means for supporting such a connector in a predetermined position;

a first series of spaced dividers disposed to define wire receiving spaces therebetween in substantial registry with and adjoining at least certain of such openings of the terminals in a connector supportedd in said predetermined position by said means, each of said dividers extending outward beyond the plane of such one end of a connector in said predetermined position for facilitating placement between said dividers of wires to be inserted in such connector, the degree of extension of each of said dividers beyond the plane of such one end of such a connector varying in relation to the particular location of the terminal registered with the wire receiving space adjacent the respective divider, and at least one of said dividers extending beyond such plane more than another of said dividers to at least facilitate identification of a wire receiving space adjoining the respective extended divider in preparation for placing a wire in such space, and said dividers being disposed to receive such wires in said wire receiving spaces while said dividers adjoin such openings; and means for moving wires aligned by said dividers into such respective terminals.

2. Apparatus as in claim 1 wherein the divider at one end of said first series of dividers extends beyond said plane to a first height and the divider at the other end of said first series of dividers extends beyond said plane to a second height, less than said first height.

3. Apparatus as in claim 1 further comprising retaining means for retaining the distal ends of wires placed in said wire receiving spaces.

4. Apparatus as in claim 3 wherein said retaining means comprises a second series of dividers substantially aligned with said dividers of said first series.

5. Apparatus as in claim 1 wherein said dividers of said first series define wire receiving spaces adjoining such side openings of such terminal in a connector supported in such predetermined position, and said means for moving wires is adapted to move such wires from between said dividers into such aligned terminals.

6. Apparatus as in claim 1 wherein said dividers of said first series define wire receiving spaces adjoining such end openings of such terminals in a connector supported in such predetermined position.

7. Apparatus as in claim 1 wherein said dividers of said first series define wire receiving spaces adjoining such side and such end openings of such terminals in a connector supported in such predetermined position.

8. Apparatus as in claim 1 wherein said dividers are maintained in spaced relationship and provide passages, between respective pairs thereof, open from an outer side of such dividers to such terminals for guiding wires through such spaces into such terminals.

9. Apparatus for inserting wires into a connector having a row of closely spaced parallel terminals each open through one side and one end of such connector comprising:

means for supporting such a connector in a predetermined position;

a first series of spaced dividers disposed to define wire receiving spaces therebetween in substantial registry with and adjoining at least certain of such openings of the terminals in a connector supported in said predetermined position by said means, each of said dividers extending outward beyond the plane of said one end of a connector in said predetermined position for facilitating placement between said dividers of wires to be inserted in such connector, the divider at one end of said first series of dividers extending beyond said plane to a first height and the divider at the other end of said first series of dividers extending beyond said plane to a second height, less than said first height and each successive divider of said first series extending outward beyond the next preceding divider, from one end of said first series to the other, and said dividers being disposed to receive such wires in said wire receiving spaces while said dividers adjoin such openings; and means for moving wires aligned by said dividers into such respective terminals.

10. Apparatus for inserting wires into terminals in a connector having a first row of closely spaced parallel terminals open through a first side of such connector, comprising:

means for supporting such a connector in a predetermined position;

a first series of spaced dividers disposed to define wire receiving spaces therebetween in substantial registry with the side openings of the terminals in said first row of terminals of a connector supported in said predetermined position by said supporting means;

each successive divider of said first series extending outward from said connector position beyond the next preceding divider, from one end of said first series to the other end, whereby said first series of dividers collectively is of a stepped configuration for ease of selective positioning of wires between said dividers by an operator; and means for moving such wires from between said dividers of said first series into such aligned terminals.

11. Apparatus as in claim 10 wherein the uppermost surface of each of said dividers is substantially parallel to a plane perpendicular to the longitudinal axes of such terminals.

12. Apparatus of claim 10 wherein said first series of spaced dividers comprises a comb including parallel ribs of varying dimensions from one end thereof to another.

13. Apparatus as in claim 10 for use with a connector including a second row of closely spaced parallel terminals open through a second side of such connector opposite said first side, further comprising:

a second series of spaced dividers disposed to define wire receiving spaces therebetween in substantial registry with the side openings of the terminals in said second row of a connector supported in said predetermined position by said supporting means;

each successive divider of said second series extending outward from said connector position beyond the next preceding divider, from one end of said second series to the other, whereby said second series of dividers collectively is of a stepped configuration for ease of selective positioning of wires between said dividers by an operator; and means for moving such wires from between said dividers of said second series into such aligned terminals.

14. Apparatus for inserting wires into a connector having a row of closely spaced parallel terminals each open through one side and one end of such connector comprising:

means for supporting such a connector in a predetermined position;

a first series of spaced dividers disposed to define wire receiving spaces therebetween in substantial registry with and adjoining at least certain of such openings of the terminals in a connector supported in said predetermined position by said means, each of said dividers extending outward beyond the plane of such one end of a connector in said predetermined position for facilitating placement between said dividers of wires to be inserted in such connector, the divider at one end of said first series of dividers extending beyond said plane to a first height and the divider at the other end of said first series of dividers extending beyond said plane to a second height less than said first height for facilitating at least the identification of at least one of said wire receiving spaces prior to wire placement therein, and said dividers being disposed to receive such wires in said wire receiving spaces while said dividers adjoin such openings; and means for moving wires aligned by said dividers into such respective terminals.

15. Apparatus for inserting wires into a connector having a row of closely spaced parallel terminals each open through one side and one end of said connector comprising:

means for supporting such a connector in a predetermined position;

a first series of spaced dividers disposed to define wire receiving spaces therebetween in substantial registry with certain of such openings of the terminals in a connector supported in said predetermined position by said means, said dividers extending outward beyond the plane of said one end of a connector in such predetermined position, the degree of extension of each of said dividers beyond the plane of said one end of such a connector varying in relation to the particular location of the terminal registered with the wire receiving space adjacent the respective divider, a plurality of said dividers extending to varying degrees beyond such plane for facilitating placement between said dividers of wires to be inserted in such connector;

means for moving such wires from between said dividers into such aligned terminals.

16. Apparatus as in claim 15 wherein a divider at one end of said first series of dividers extends beyond said plane to a first height and the divider at the other end of said first series of dividers extends beyond said plane to a second height, less than said first height, for aiding in identification of particular wire receiving spaces and thereby facilitating placement between said dividers of wires to be inserted in such connector.

17. Apparatus for inserting wires into a connector having a row of closely spaced parallel terminals each open through one side and one end of said connector comprising:

means for supporting such a connector in a predetermined position;

a first series of spaced dividers disposed to define wire receiving spaces therebetween in substantial registry with the side openings of the terminals in a connector supported in said predetermined position by said means, each of said dividers extending outward beyond the plane of said one end of a connector in said predetermined position for facilitating placement between said dividers of wires to be inserted in such connector, the divider on one end of said first series of dividers extending beyond said plane to a first height and the divider at the other end of said first series of dividers extending beyond said plane to a second height, less than said first height, each successive divider of said first series extending outward beyond the next preceding divider, from one end of said first series to the other; and means for moving such wires from between said dividers into such aligned terminals.

* * * * *

UNITED STATES PATENT OFFICE
CERTIFICATE OF CORRECTION

Patent No. 3,999,270 Dated December 28, 1976

Inventor(s) Roy Witte

It is certified that error appears in the above-identified patent and that said Letters Patent are hereby corrected as shown below:

| | |
|---|---|
| Col. 3, line 9 | "receving" should be --receiving-- |
| Col. 3, line 23 | "As an" should be --An-- |
| Col. 4, line 2 | After "end of" insert --each of-- |
| Col. 4, line 21 | After "includes" insert --a-- |
| Col. 5, line 28 | "bridges" should be --bridging-- |
| Col. 7, line 44 | "contact" should be --contactor-- |
| Col. 7, line 68 | "row" should be --rows-- |

UNITED STATES PATENT OFFICE
CERTIFICATE OF CORRECTION

Patent No. 3,999,270 Dated December 28, 1976

Inventor(s) Roy Witte

It is certified that error appears in the above-identified patent and that said Letters Patent are hereby corrected as shown below:

| | |
|---|---|
| Col. 8, line 1 | "rib" should be --ribs-- |
| Col. 8, lines 36 and 37 | Delete "This results in the translation of the side members leased. |
| Col. 8, line 48 | "196" should be --186-- |
| Col. 9, line 21 | "havng" should be --having-- |
| Col. 9, line 32 | "48d" should be --48b-- |
| Col. 10, lines 14 and 15 Claim 1 | "supportedd" should be --supported-- |

Signed and Sealed this

Seventeenth Day of May 1977

[SEAL]

*Attest:*

RUTH C. MASON
*Attesting Officer*

C. MARSHALL DANN
*Commissioner of Patents and Trademarks*